US008029151B2

(12) United States Patent
Butler

(10) Patent No.: US 8,029,151 B2
(45) Date of Patent: Oct. 4, 2011

(54) BACK-UP LIGHTING SYSTEM

(75) Inventor: Doyle Scott Butler, Dunwoody, GA (US)

(73) Assignee: ABL IP Holding LLC, Conyers, GA (US)

( * ) Notice: Subject to any disclaimer, the term of this patent is extended or adjusted under 35 U.S.C. 154(b) by 255 days.

(21) Appl. No.: 12/409,167

(22) Filed: Mar. 23, 2009

(65) Prior Publication Data

US 2009/0244881 A1 Oct. 1, 2009

Related U.S. Application Data

(60) Provisional application No. 61/039,969, filed on Mar. 27, 2008.

(51) Int. Cl.
*F21V 19/04* (2006.01)

(52) U.S. Cl. ..... 362/20; 362/249.02; 362/276; 362/431

(58) Field of Classification Search ..... 362/20, 362/147, 228, 240, 249.01, 249.02, 249.05, 362/249.12, 260, 276, 395, 410, 413, 414, 362/418, 431, 432, 800, 802; 315/86–88, 315/154

See application file for complete search history.

(56) References Cited

U.S. PATENT DOCUMENTS

| | | | | |
|---|---|---|---|---|
| 1,349,478 | A | 8/1920 | Sugimura | |
| 2,456,179 | A * | 12/1948 | Finer | 362/431 |
| 3,679,891 | A * | 7/1972 | Quack | 362/309 |
| 3,683,172 | A | 8/1972 | Noyes | |
| 3,976,986 | A | 8/1976 | Zabroski | |
| 4,020,858 | A | 5/1977 | Wilson | |
| 4,166,601 | A | 9/1979 | Kato | |
| 4,174,532 | A | 11/1979 | Kelley | |
| 4,225,909 | A * | 9/1980 | Scholz et al. | 362/367 |
| 4,264,945 | A | 4/1981 | Ullman | |
| 4,319,312 | A | 3/1982 | de Vos et al. | |
| 4,425,602 | A | 1/1984 | Lansing | |

(Continued)

FOREIGN PATENT DOCUMENTS

EP 0240066 10/1987

(Continued)

OTHER PUBLICATIONS

Rechargeable Umbrella Light, Product No. 18916 (item no longer available); http://www.frontgate.com/jump.jsp?item=18916 &maincatcode_1&subcatcode=null&itemType=PRODUCT &path=1%2C2%2C145%2C799&iProductID=510; Admitted Prior Art.

(Continued)

*Primary Examiner* — Hargobind Sawhney
(74) *Attorney, Agent, or Firm* — Kilpatrick Townsend & Stockton LLP

(57) ABSTRACT

Embodiments of this invention provide a secondary, or back-up, lighting system for light fixtures having a primary light source. The back-up lighting system is configured to mount onto a support structure of the light fixture. The back-up lighting system includes a light source and a lens with optical properties. A housing retains the light source and lens. The back-up lighting system may include a controller that monitors the main power source for the primary light source of the light fixture. The controller activates the light source of the back-up lighting system upon detecting power restoration after a power loss. In some embodiments of this invention, the back-up lighting system includes a secondary power source that powers the back-up lighting system during a loss of power.

23 Claims, 7 Drawing Sheets

U.S. PATENT DOCUMENTS

| | | | | |
|---|---|---|---|---|
| D283,647 | S | 4/1986 | Schumann | |
| 4,600,979 | A | 7/1986 | Fisher et al. | |
| D285,010 | S | 8/1986 | Mullins | |
| 4,729,076 | A * | 3/1988 | Masami et al. | 362/235 |
| 4,751,398 | A | 6/1988 | Ertz | |
| 4,787,019 | A | 11/1988 | van den Broeke | |
| 4,847,741 | A | 7/1989 | Boettinger | |
| 5,007,811 | A | 4/1991 | Hopkins | |
| 5,062,028 | A | 10/1991 | Frost et al. | |
| 5,105,350 | A * | 4/1992 | Tolman et al. | 362/431 |
| 5,134,550 | A | 7/1992 | Young | |
| 5,152,601 | A | 10/1992 | Ferng | |
| 5,426,574 | A | 6/1995 | Carolfi | |
| 5,584,564 | A | 12/1996 | Phyle | |
| D391,384 | S | 2/1998 | Lerch | |
| D391,657 | S | 3/1998 | Compton | |
| D402,386 | S | 12/1998 | Compton | |
| 5,911,499 | A | 6/1999 | Stafford et al. | |
| 6,053,621 | A | 4/2000 | Yoneda | |
| D426,010 | S | 5/2000 | Compton | |
| 6,392,563 | B1 * | 5/2002 | Paquette et al. | 340/907 |
| D468,472 | S | 1/2003 | Mullally et al. | |
| D475,801 | S | 6/2003 | Stewart | |
| 6,682,204 | B2 | 1/2004 | Mullally et al. | |
| D488,879 | S | 4/2004 | Brown et al. | |
| 6,778,093 | B2 | 8/2004 | Harwood | |
| D497,447 | S | 10/2004 | Yoneda | |
| 6,876,152 | B2 | 4/2005 | Jeon | |
| 6,899,444 | B1 | 5/2005 | Biber et al. | |
| 7,034,466 | B2 | 4/2006 | Tsao | |
| 7,041,899 | B2 | 5/2006 | Stekelenburg | |
| 7,178,952 | B2 | 2/2007 | Bucher et al. | |
| 7,196,477 | B2 | 3/2007 | Richmond | |
| D542,454 | S | 5/2007 | Chan | |
| D558,908 | S | 1/2008 | Waedeled | |
| D564,687 | S | 3/2008 | Bucher et al. | |
| D567,424 | S | 4/2008 | St-Pierre et al. | |
| 2002/0149929 | A1 | 10/2002 | Evans et al. | |
| 2002/0191391 | A1 | 12/2002 | Van Etten | |
| 2004/0105264 | A1 | 6/2004 | Spero | |
| 2005/0117326 | A1 | 6/2005 | Ma | |
| 2007/0070628 | A1 | 3/2007 | Chen | |
| 2007/0159834 | A1 * | 7/2007 | Chen | 362/395 |
| 2007/0211461 | A1 | 9/2007 | Harwood | |
| 2007/0247840 | A1 | 10/2007 | Ham | |
| 2008/0030988 | A1 | 2/2008 | Williams | |
| 2008/0080162 | A1 | 4/2008 | Wilcox et al. | |

FOREIGN PATENT DOCUMENTS

| | | |
|---|---|---|
| EP | 0490647 | 6/1992 |
| EP | 0836368 | 4/1998 |
| JP | 2006196316 | 7/2006 |
| WO | WO-0059268 | 10/2000 |

OTHER PUBLICATIONS

E-Light Indoor/Outdoor Entertainment Light; Product No. 28334; http://www.frontgate.com/mercadoSearch.do?action=search &newSearch=true&freeText=28334; Admitted Prior Art.

Avalon Rechargeble Umbrella Light; Product No. 28422; http:// www.frontgate.com/mercadoSearch.do?action=search &newSearch=true&freeText=28422; Admitted Prior Art.

* cited by examiner

BACK-UP LIGHTING SYSTEM

CROSS REFERENCE TO RELATED APPLICATIONS

This application claims the benefit of U.S. provisional application Ser. No. 61/039,969, entitled "LED Ring Light", filed Mar. 27, 2008, the entire contents of which is hereby incorporated by reference.

FIELD OF THE INVENTION

Embodiments of the invention generally relate to secondary or back-up lighting systems.

BACKGROUND OF THE INVENTION

Traditional outdoor light applications are designed to widely disperse light over large areas. These outdoor light fixtures are found in parking lots, activity areas like parks and athletic fields, and aligned along streets and sidewalks, and other high traffic areas. Many of these outdoor light fixtures utilize a high intensity discharge (HID) lamp that produces enough illumination to fully light the outdoor areas. A HID lamp is favorable over other light sources, such as fluorescent and incandescent lamps, because HID lamps have greater luminous efficacy.

While highly efficient, a HID lamp must be in a cooled state before it can be activated. Once activated, HID lights must cool down before they can be reactivated. HID lamps take a considerable amount of time to cool down after any use. The cool down period can be in excess of fifteen minutes. When an outdoor light fixture utilizing a HID lamp experiences a power interruption, the area surrounding the light fixture is devoid of light until the HID lamp has cooled and can be re-activated. The absence of light during the required cool down period can leave individuals and property in unsafe situations.

The common practice within the industry to counteract the lack of light during the cool down period is to employ a Quartz Restrike System ("QRS"). A QRS adds an incandescent quartz light source inside the HID lamp housing to provide instant light when power is restored. However, due to the height at which the luminaire housing is mounted, the fact that the optics for the light are optimized for the HID lamp (and not the quartz light source), and the low intensity of the quartz source, not much light reaches the ground below. Therefore, there is a need to provide immediate illumination after a power interruption until the HID lamp has fully cooled and can be reactivated. Additionally, there is a need for this light to adequately illuminate the areas surrounding the outdoor light fixture during the cool down period.

SUMMARY OF THE EMBODIMENTS OF THE INVENTION

Embodiments of this invention provide a secondary, or back-up, lighting system for light fixtures having a primary light source. The back-up lighting system is configured to mount onto a support structure of the primary light fixture. The back-up lighting system includes a light source and a lens with optical properties. A housing retains the light source and the lens. The back-up lighting system may include a controller that monitors the main power source for the primary light source of the light fixture. The controller activates the light source of the back-up lighting system upon detecting power restoration after a power loss. In some embodiments of this invention, the back-up lighting system may include a secondary power source that powers the back-up lighting system during a loss of power.

DETAILED DESCRIPTION OF EMBODIMENTS OF THE INVENTION

Figure 1:
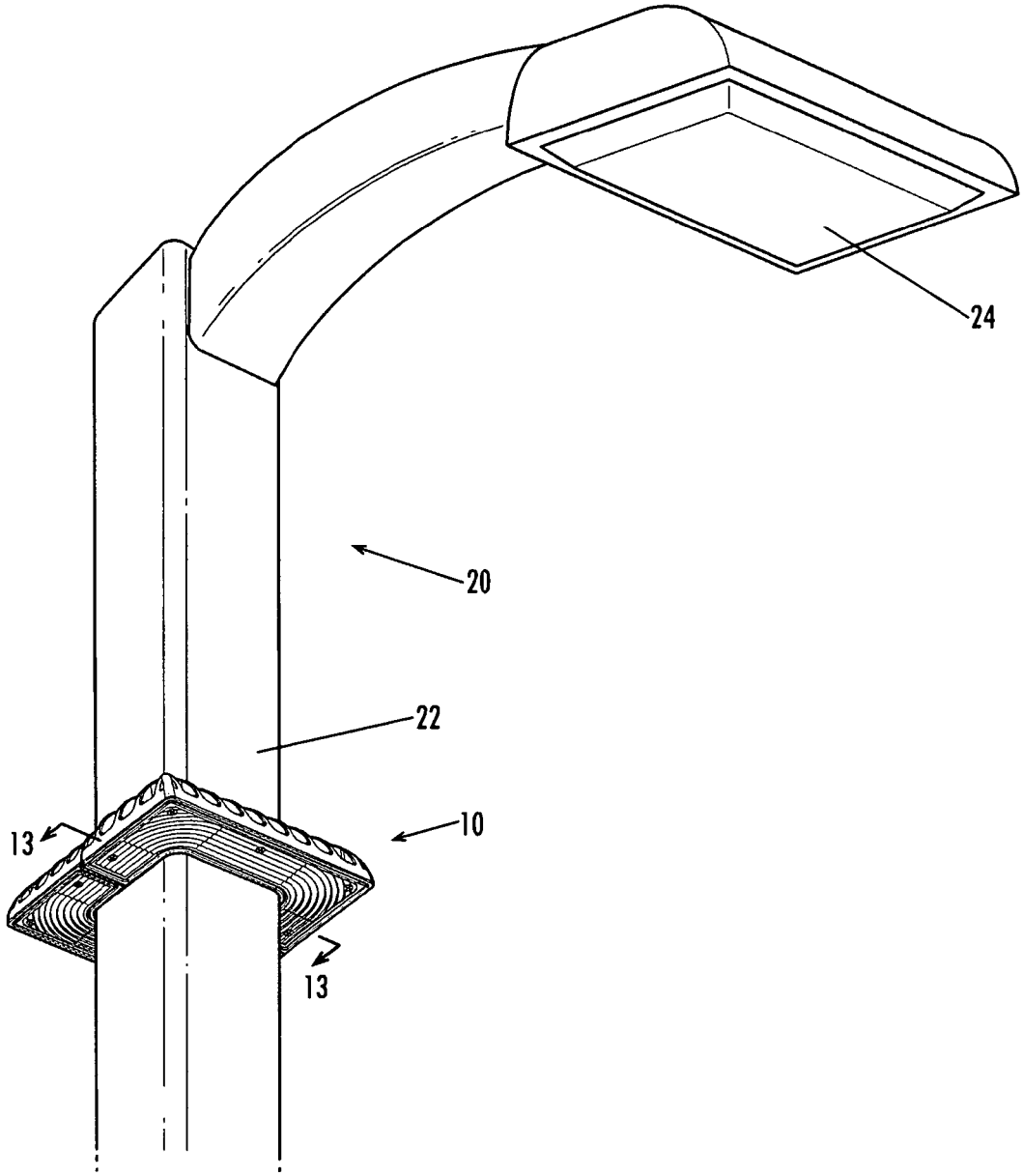
FIG. 1 is a bottom perspective view of a back-up lighting system mounted on a pole of a primary light fixture according to one embodiment of this invention.
Figure 2:
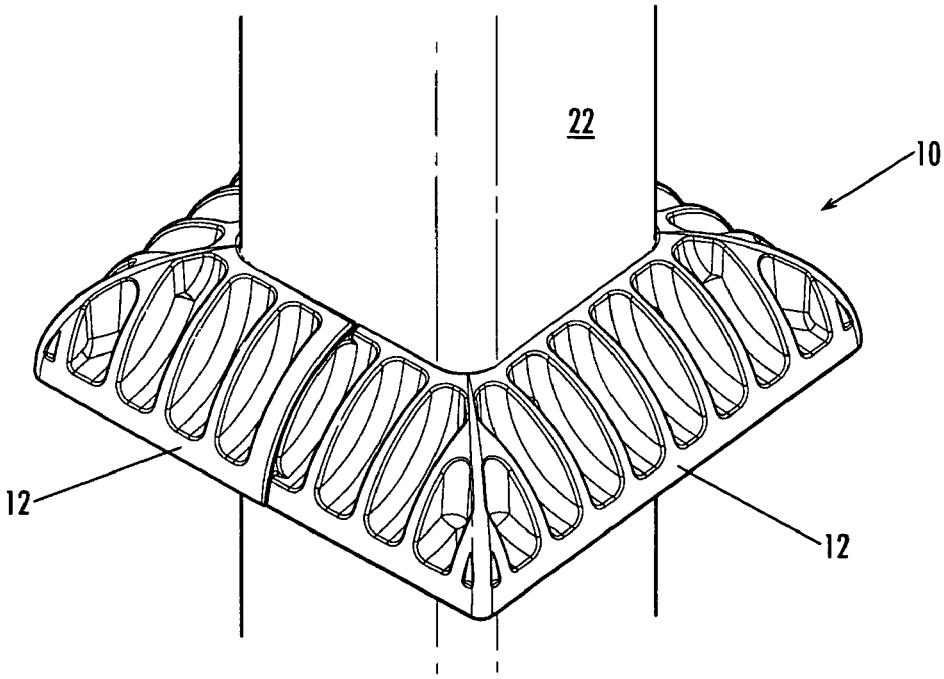
FIG. 2 is a top perspective view of the back-up lighting system of FIG. 1.
Figure 3:
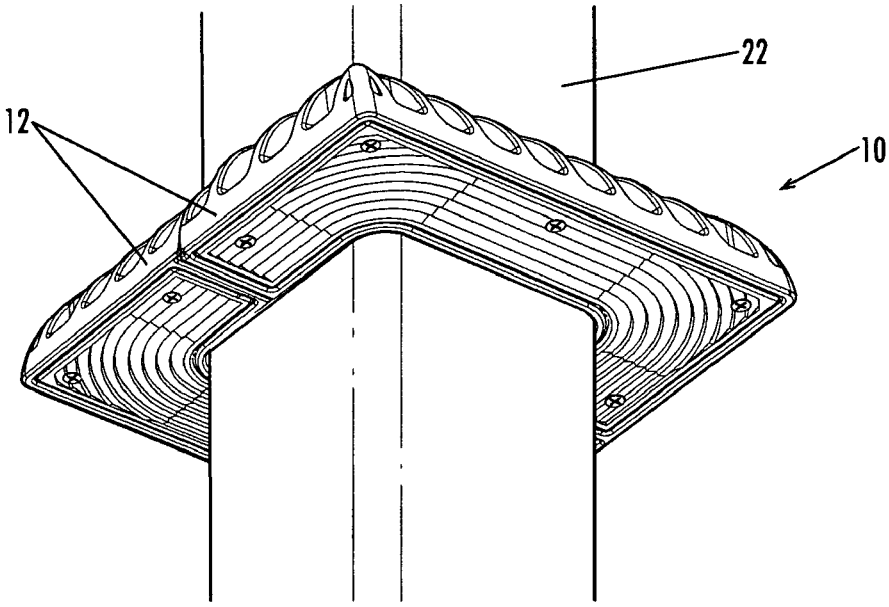
FIG. 3 is a bottom perspective view of the back-up lighting system of FIG. 1.

Embodiments of this invention provide a back-up lighting system for use as a secondary light source immediately after power restoration following a power loss and before the primary light source can be re-activated. The back-up lighting system may be attached to any suitable light fixture, including, but not limited to, outdoor fixtures such as parking lot, street, and sidewalk lamps. In some embodiments of this invention, the back-up lighting system may include a secondary power source, allowing the back-up lighting system to provide adequate and immediate illumination during power outages.

FIGS. 1-10 illustrate a back-up lighting system 10 according to an embodiment of this invention. The back-up lighting system 10 is configured to be used with a primary light fixture 20. In the illustrated embodiments, the primary light fixture 20 is an outdoor fixture. However, the back-up lighting systems 10 of the invention are not limited for use with outdoor fixtures. The primary light fixture 20 includes a support structure 22 (a pole as shown) that supports a primary light source 24. The primary light source 24 can be an HID lamp. However, other light sources may be used in the primary light source 24. The illustrated back-up lighting system 10 is rectilinear-shaped and corresponds to the cross-sectional shape of the support structure 22. However, the back-up lighting system 10 may have any shape (including, but not limited to, circular, triangular, etc.) and, while preferable, need not correspond to the shape of the support structure 22 on which it is mounted.

Figure 9:
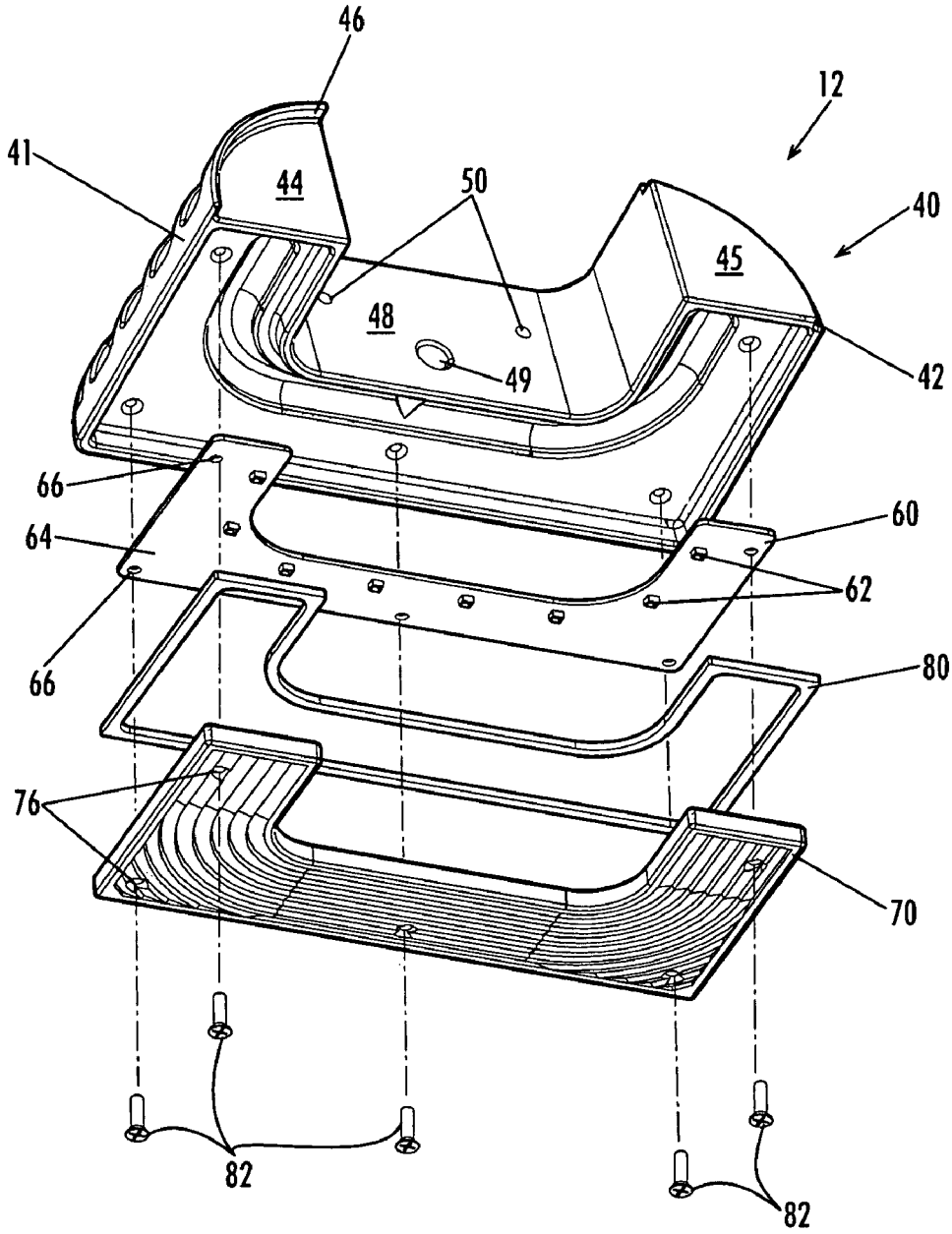
FIG. 9 is an exploded view of the component of FIG. 7.
Figure 10:
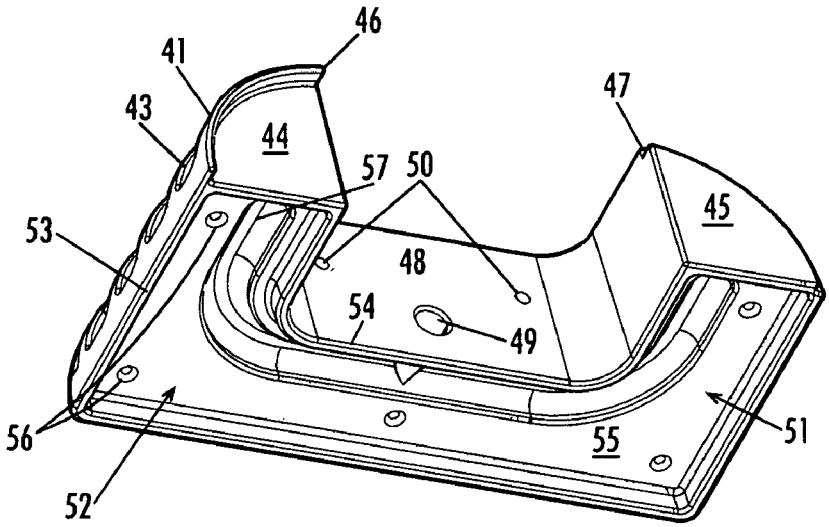
FIG. 10 is a bottom perspective view of the housing of the component of FIG. 7.
Figure 11:
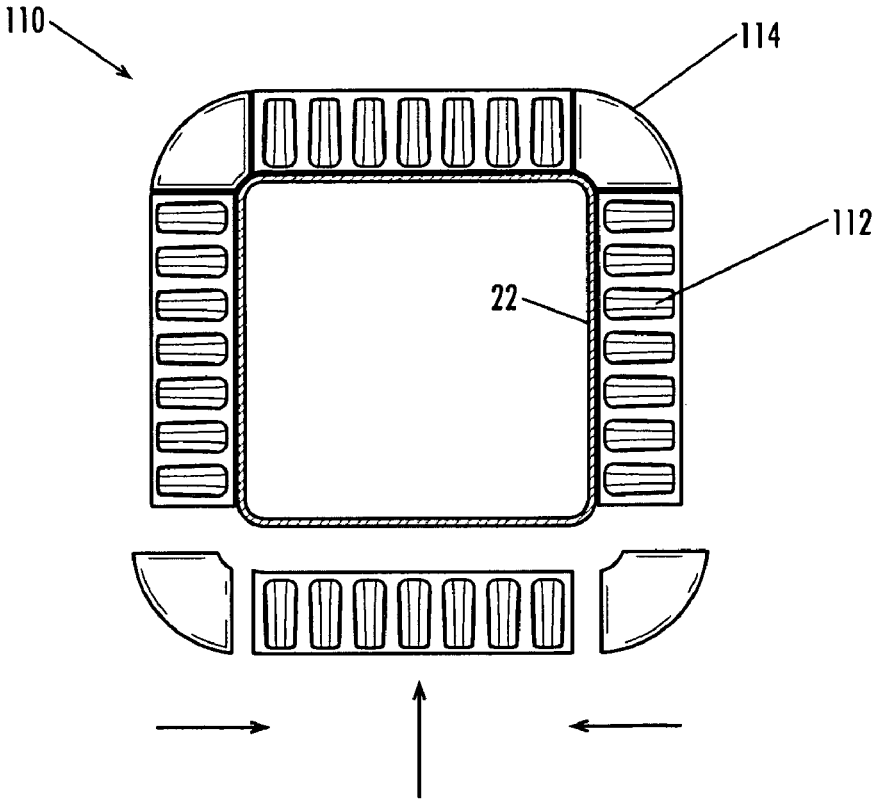
FIG. 11 is top plan view of an alternative back-up lighting system mounted on a pole according to another embodiment of this invention.

As shown in FIGS. 1-10, the back-up lighting system 10 can be formed from single or multiple components. In the embodiment of FIGS. 1-10, the back-up lighting system 10 is formed from two components 12. The separate components 12 allow the back-up lighting system 10 to easily mount around the support structure 22. In other embodiments, the back-up lighting system 10 may be formed from more than two pieces. For example, as shown in FIG. 11, the back-up lighting system 110 may be formed from multiple side pieces 112 and corner pieces 114 that connect together. While the back-up lighting system 10 may be formed from a number of combinations of components, it may be desirable to use fewer components to reduce the number of parts and reduce mounting time. Moreover, in some embodiments the back-up lighting system 10 does not extend around the entirety of the support structure.

Figure 4:
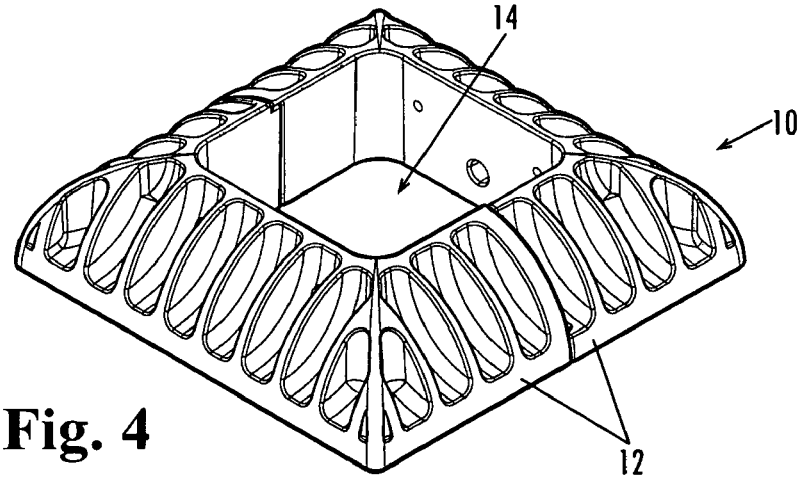
FIG. 4 is a top perspective view of the back-up lighting system of FIG. 1 unmounted.

As illustrated in FIG. 4, an aperture 14 is formed in the back-up lighting system 10 when the components 12 are assembled together. The aperture 14 allows the back-up lighting system 10 to mount to and surround the support structure 22. As shown in FIGS. 1-10, the aperture 14 of the back-up lighting system 12 corresponds to the rectilinear shape of the support structure 22. The aperture 14, however, is not limited only to a rectilinear shape, but may have any suitable shape. For example, a back-up lighting system may have a circular shaped aperture for a circular support structure. However, in some embodiments the shape of the aperture 14 of the back-up lighting system 10 does not match the cross-sectional shape of the support structure 22.

While back-up lighting systems 10 may be manufactured so that their apertures 14 are sized to fit precisely around a particular support structure 22, it may be preferable to provide a back-up lighting system 10 that can be adapted to fit universally on a variety of different support structures 22. If the aperture 14 of a back-up lighting system 10 is larger than the dimensions of the support structure 22, a gap exists between the support structure 22 and the back-up lighting system 10 when the back-up lighting system 10 is mounted. In some embodiments, the size of the aperture 14 of the back-up lighting system 10 may be adjustable. For example, expandable flanges may be connected to the backside of the components 12 of the back-up lighting system 10. The flanges may be extended or retracted as necessary to eliminate the gap between the backside of the components 12 and the support structure 22.

Figure 5:
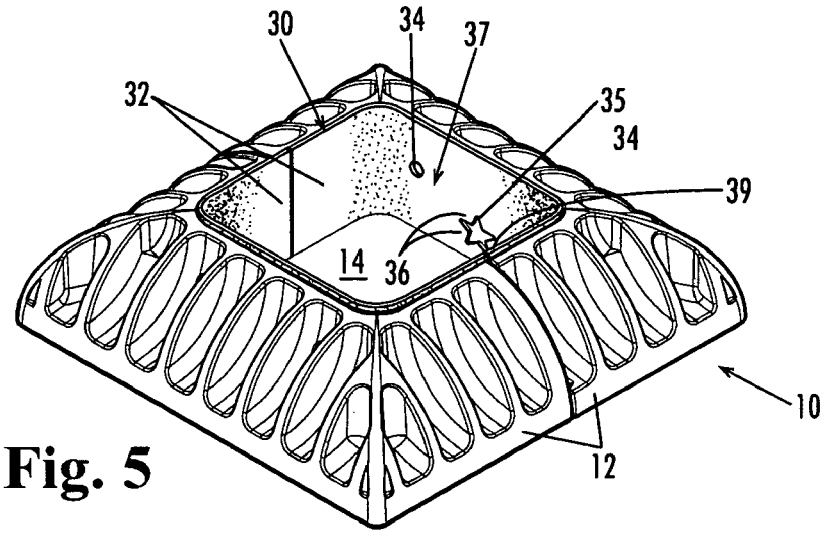
FIG. 5 is a top perspective view of the back-up lighting system of FIG. 4 provided with a gasket.
Figure 6:
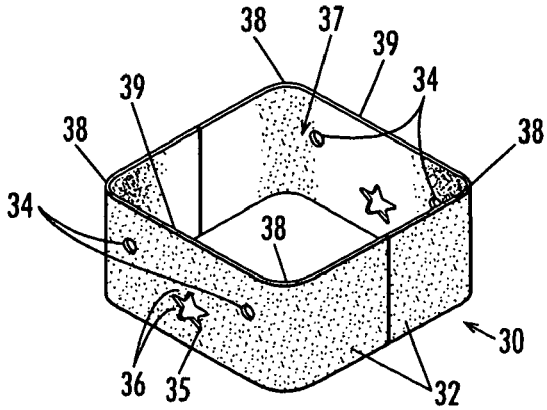
FIG. 6 is a top perspective view of the gasket of the back-up lighting system of FIG. 5.

In other embodiments, a mounting gasket 30 may be used to address the gaps and ensure a secure mount. As shown in FIGS. 5-6, the mounting gasket 30 is formed of a compressible material (e.g., silicone sponge, rubber, neoprene, etc.) that fits within the aperture 14 of the back-up lighting system 10 and around the support structure 22. The mounting gasket 30 may be formed from separate components 32, with each gasket component 32 corresponding to a component 12 of the back-up lighting system 10. The gasket 30 may be provided with mounting apertures 34 that are configured to receive fasteners for securing the gasket 30 to the back-up lighting system 10. The gasket 30 may also include a wire aperture 35 that provides a pathway for the wiring of the light source retained within the component 12, as will be discussed further below. The wire aperture 35 may include tips 36 that extended into the aperture 35, giving the wire aperture 35 a star shaped. The tips 36 can bend and extend outwards to surround wiring exiting through the wire aperture 35, creating a protective barrier for the wiring.

A gasket aperture 37 is defined in the mounting gasket 30. The gasket aperture 37 preferably, but not necessarily, corresponds to the cross-sectional shape of the mounting structure 22 and can also, but does not have to, correspond to the shape of the aperture 14 of the back-up lighting system 10. The back-up lighting system 10 is adapted to receive different mounting gaskets 30 depending on the cross-sectional shape and size of the support structure 22 on which it is intended to be mounted.

The mounting gasket 30 eliminates gaps and prevents the back-up lighting system 10 from shifting while mounted on the support structure 22. However, gaps can still exist when a gasket 30 is positioned when mounting a back-up lighting system 10 having a rectilinear aperture 14 to a support structure 22 with a rectilinear shape. Rectilinear shaped support structures may have rounded corners. The rounding of the corners can vary from 1/16 of an inch to ½ of an inch. The variance among the rounding of the corners would require gaskets 30 to be produced that substantially match the possible ranges. A gasket having dual-durometer properties may be used to solve this problem. The dual durometer gasket 30 has two different compressibilities, a high compressibility at the corner portions 38 and a lower compressibility at the middle portions 39. The gasket 30 can be designed to eliminate gaps formed by the largest possible rounding of the corners, but still be used with the rectilinear support structures having less-rounded corners because of the high compressibility of the corners 38 of the gasket 30. The high compressibility of the corners 38 allows the unneeded material to be displaced, or compressed, by rectilinear support structures 22 having less-rounded corners.

Figure 12:
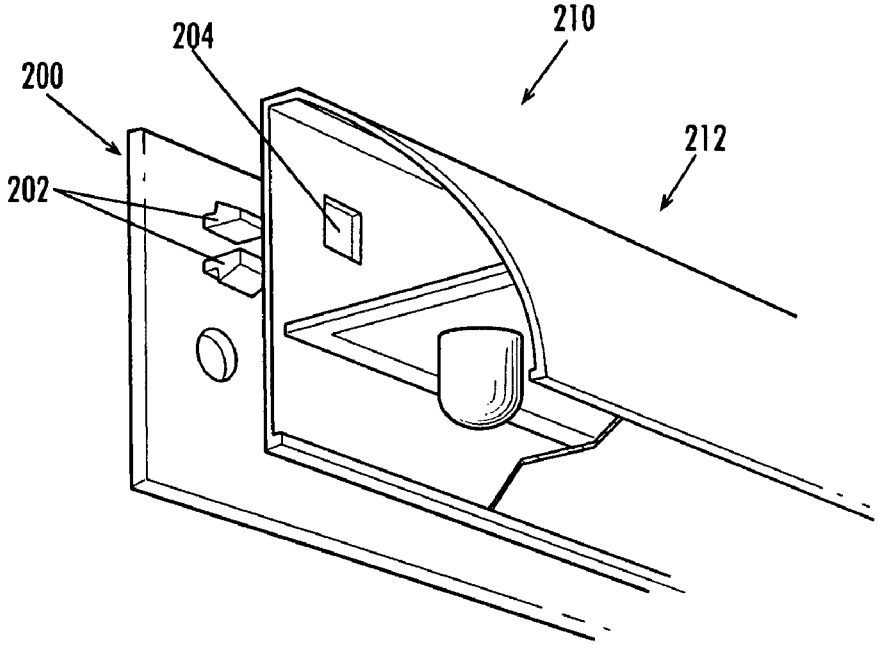
FIG. 12 is a partial perspective view of a back-up lighting system according to another embodiment of this invention.

Other means of ensuring a secure fit between the back-up lighting system 10 and the support structure 22 may be used. As shown in FIG. 12, a mounting board(s) 200 can mount directly to the support structure 22. The mounting board 200 is shaped to extend along at least a portion of the circumference of the support structure 22. The back-up lighting system 210, in turn, mounts onto the mounting board 200 via any mechanical retention method (e.g., screws, fasteners, tab/slot configuration, etc.). In one embodiment, the mounting board 200 can include tabs 202 that are received by slots 204 on the backside of the components 212 of the back-up lighting system 210. In such embodiments, the back-up lighting system 210 can, but does not need to, extend fully around the support structure 22.

Figure 7:
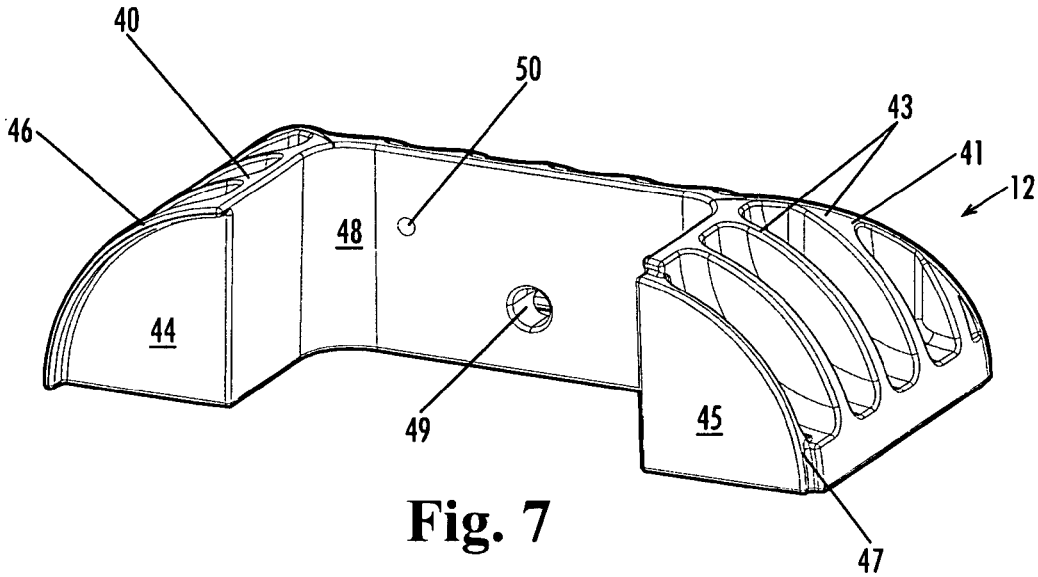
FIG. 7 is a top perspective view of a component of the back-up lighting system of FIG. 4.
Figure 8:
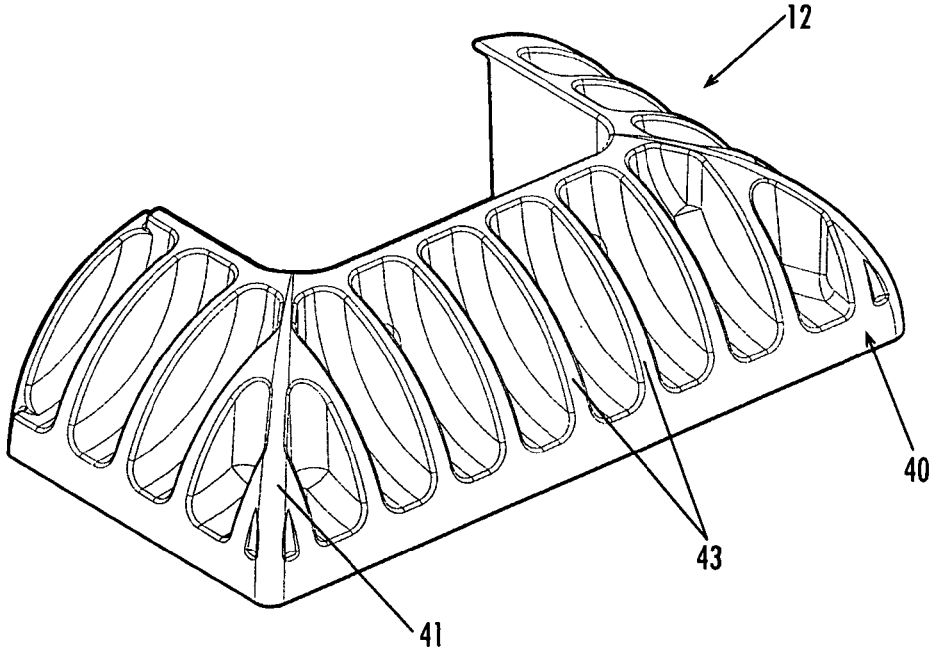
FIG. 8 is an alternative top perspective view of the component of FIG. 7.

FIGS. 7-9 illustrate a component 12 of the back-up lighting system 10 according to one embodiment of this invention. The component 12 includes a housing 40 that houses a light source 60, a lens 70, and an optional sealing gasket 80. As explained earlier, the shape of the back-up lighting system 10 and thus of the component 12 is not limited. However, it is preferable that the back-up lighting system 10 is shaped and sized so that the lighting system 10 does not obstruct the light emitted from the primary light source 26. In the embodiment illustrated in FIGS. 7-10, the housing 40 has a downwardly sloping outer surface 41 to impart a sleek appearance to the lighting system 10 as well as limit light obstruction of the primary light source 24.

Fins 43 are preferably formed on the outer surface 41 of the housing 40. The fins 43 dissipate heat generated by the light source 60. In order to further assist in the heat dissipation, the housing 40 can be manufactured from aluminum. While aluminum is preferable, the housing 40 may be made from steel, copper, or other various heat-conducive materials.

The housing 40 includes ends 44 and 45 adapted to abut corresponding ends on the opposite component 12 when the back-up lighting system 10 is mounted, as shown in FIGS. 4-5. Structure may be, but does not have to be, provided on ends 44, 45 so that the ends 44, 45 of components 12 align and engage during installation. In one embodiment, a tongue 46 is provided on one end 44 while a groove 47 is provided on the other end 45. When the two components 12 are mounted to form the back-up lighting system 10, the tongues 46 are received by the grooves 47. The tongue 46 and groove 47 ensure proper alignment of the components, thereby facilitating a seamless appearance between the two components 12. The ends 44, 45 of the components 12 can be, but do not have to be, secured together. For example, apertures configured to receive fasteners may be provided in the ends 44 and 45 to further secure the components 12 to one another when mounted.

A wire aperture 49 is preferably positioned along the inner surface 48 of the component 12. The wire aperture 49 provides a pathway for the wiring from the light source 60 to the exterior of the housing. Mounting apertures 50 may also be found along the inner surface 48 of the housing 40, and extend through to the outer surface 41. Fastening means, such as screws, bolts, and the like, may be received by the mounting apertures 50 to mount the back-up lighting system components 12 to the support structure 22. The mounting apertures 50 may be aligned between fins 43 of the housing 40 in order to hide fastening means from view.

The interior 51 of the housing 40 receives a light source 60, lens 70, and an optional sealing gasket 80 (collectively "internal components"). The underside of the housing 40 may be adapted to ensure retention of the internal components in place. For example, as illustrated in FIG. 10, a trough 52 is provided in the interior 51 of housing 40 and preferably, but not necessarily, has a shape that corresponds to that of the internal components. The trough 52 is defined by an outer edge 53, an inner edge 54 and a seat 55. The internal components are received in the trough 52. The seat 55 may be provided with a number of apertures 56 that receive fasteners to secure the internal components. A channel 57 may be provided to accommodate the circuitry and wiring of the light source 60. The wire aperture 49 gains access into the interior 51 through the channel 57.

In the embodiment shown in FIG. 9, the light source 60 includes light emitting diodes ("LEDs") 62. Note, however, that other back-up lighting systems 10 may use other types of light sources and is not limited to use with only LEDs 62. Light sources such as, but not limited to, organic LEDs, incandescents, and fluorescents may be used. While other light sources may be used, LEDs are preferable based on their ability to reach full illumination capacity as soon as activated as well as their efficiency. The LEDs used may vary in their luminaire capacity, as well as the spectrum of light produced, depending on the needs of a particular application.

Any number of LEDs 62 are mounted to a light board 64 substantially shaped to match the shape of the trough 52 of the housing 40 to ensure a good fit within the housing 40. The LEDs 62 may be mounted on various parts of the light board and in any pattern, depending on the optical needs of the back-up lighting system 10. The circuitry of the LEDs may be mounted on the opposite side of the light board 64. Preferably, the circuitry is positioned on the light board 64 to align with the channel 57 of the housing 40 when installed, but it does not have to be. Apertures 66 may be positioned along the light board 64 in alignment with the apertures 56 of the housing 40.

A lens 70 encloses the light source 60 within the housing 40. The lens 70 is preferably formed of a transparent material. Preferably, the transparent material is a polymeric material, such as, but not limited to, polycarbonate, polystyrene, or acrylic. Use of polymeric materials allows the lens 70 to be injection-molded, but other manufacturing methods, such as, but not limited to, machining, stamping, compression-molding, etc., may also be employed. While polymeric materials may be preferred, other clear materials, such as, but not limited to, glass, topaz, sapphire, silicone, apoxy resin, etc. can be used to form the lens 70. It is desirable to use materials that have the ability to withstand exposure to a wide range of temperatures and non-yellowing capabilities with respect to ultraviolet light.

Just as with the light board 64, the lens 70 is preferably shaped to match the shape of the trough 55 to ensure a tight fit within the housing 40. When mounted within the housing 40, the lens 70 provides protection for the electrical components from the surrounding environment. Apertures 76 may be positioned along the lens 70 in alignment with the apertures 56 and 66 of the housing 40 and light board 64, respectively. A sealing gasket 80, substantially tracing the outline of the trough 55, may be placed between the lens 70 and the housing 40 to further weather proof the internal components of the light ring 10. A fastener, such as the screws 82 shown in FIG. 9, may be inserted through apertures 76, 66, and 56 respectively to secure the lens 70, light source 60, and housing together 40.

While the lens 70 protects the interior of the housing 40, it also controls the light distribution of the light source 60. The optical properties of the lens 70 dictate the distribution of the light emitted from the LEDs. The particular optical properties of the lens are not critical to embodiments of the invention. Rather, the lens 70 may be formed to have any optical properties that impart the desired light distribution(s). One of skill in the art would understand how to impart such properties to the lens 70 to effectuate the desired light distribution. However, by providing optics tailored to a particular application, the back-up lighting system 10 creates a more efficient secondary light distribution that illuminates the needed areas more effectively than the traditional quartz back-up systems discussed above.

As shown in FIGS. 1-3 and 13, the back-up lighting system 10 is mounted to the support structure 22 of the primary lighting fixture 20. The back-up lighting system 10 is mounted below the primary light source 24, placing the back-up lighting system 10 and the light it produces closer to the ground. However, the back-up lighting system's exact mounting location may vary depending on its particular application. Apertures (not shown) configured to receive mounting screws or bolts may be provided in the support structure 22. The location of such apertures corresponds to the mounting apertures 50 of the housing components 12. In the case of newly installed primary light fixtures 20, the apertures may already be provided in the structure 22. However, when the back-up lighting system 10 is mounted to an existing primary light fixture 20, the apertures may be added to the support structure 22. Note, however, that the back-up lighting system 10 may use other types of mounting means and is not limited to mounting through the aperture/fastener combination. For example, as discussed above, a mounting board 200 may be secured to the support structure 22, with the components 212 snap-fitting to its tabs 204. Mounting means such as, but not limited to, welding, chemical adhesion, and clamps may also be used.

Figure 13:
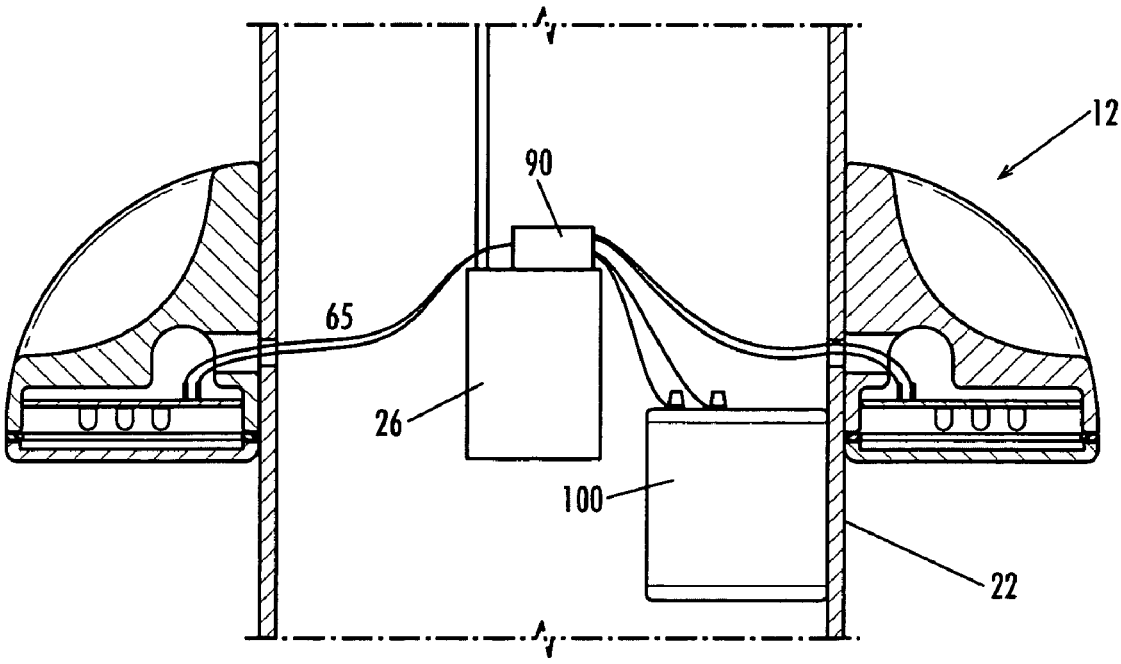
FIG. 13 is a cross-sectional view taken along line 13-13 of FIG. 1.

As shown in FIG. 13, the back-up lighting system 10 may be wired to certain internal components contained within the primary light fixture 20. For example, components 12 of the back-up lighting system 10 may be wired to a controller 90. As shown, the controller 90 may be located within the primary light fixture's support structure 22. However, in other embodiments, the controller 90 may be housed within the housing 40 of one of the components 12 of the back-up lighting system 10. The controller 90, often referred to as a relay, is connected to the power source 26 of the primary light fixture 20. The controller 90 monitors the supply of power to the primary light fixture 20 for certain conditions and controls the activity of the back-up lighting system 10 based upon the presence of such conditions, which will be discussed below. As shown, the controller 90 is connected to a ballast 26 of the primary light fixture 20. The controller 90 may supply power to the back-up lighting system 10 through its connection to the ballast 26. However, the back-up lighting system 10 may be connected to its own dedicated power input line. The back-up lighting system 10 may also be connected to a secondary power source 100. Preferably, the secondary power source 100 is self contained, such as a battery, and is not connected to the main power source 26. In some embodiments, the secondary power source 100 may be contained within the housing 40 of the components 12. The light sources 60 of the back-up lighting system 10 can be powered by the main power source 26 of the primary light fixture 20 or by a dedicated power input line. Also, when power is not available from either the input line or the ballast 26, and the secondary power source 100 is available, the light source 60 may receive its power from the secondary power source 100.

In one embodiment, the controller 90 monitors for a temporary loss of power to the primary light source 24. More specifically, the controller 90 monitors for an interruption and the return of the power to the primary light source 24. When a temporary loss of power is sensed, the controller 90 activates the light source 60 of the back-up lighting system 10. Since the power has been restored to the main power source 26, the light sources 60 can be powered by the main power source 26. When there is a dedicated power input line for the back-up lighting system 10, the light sources 60 may be powered by the dedicated power input line, so long as the input line is operable. Upon activation, the back-up lighting system 10 immediately provides full illumination. The controller 90 continues to monitor the power supply and can deactivate the back-up lighting system 10 once enough time has passed to allow the primary light source 24 to cool and reactivate. The controller 90 may also monitor for the complete loss of power when a secondary power source 100 is available. When a loss of power is sensed, the controller 90 activates the back-up lighting system 10, drawing power from the secondary power source 100, to provide light while the primary power source 26 is inoperable. The back-up lighting system 10 will continue to operate until the power is restored to the primary light source 24 (as long as the primary light source has cooled), as is indicated by the controller 90, or until the secondary source 100 is completely depleted.

The combination of the back-up lighting system 10 components leads to a much more desirable secondary light source than one currently supplied within traditional primary light fixtures, especially ones using a QRS system. First, the back-up lighting system 10 may have optics configured specifically for its own light source and need not rely on the optics designed for the primary light source. Second, the back-up lighting system 10 utilizes a light source 60 that produces a greater intensity of light than that of other secondary light systems. The greater intensity leads to a greater amount of light produced. Third, the back-up lighting system 10 is mounted below the primary light source 24, as opposed to within the primary light source 24. As a result, the back-up lighting system 10, and the light it produces, is closer to the ground. The combination of these factors leads to more efficient and effective illumination during periods of inoperability of the primary light fixture 20.

The foregoing has been provided for purposes of illustration of an embodiment of the present invention. For example, the back-up lighting system may be mounted upside down to provide light upwardly to features located above the back-up lighting system. In other embodiments, the lens may be configured to direct light to a very specific location. Modifications and changes may be made to the structures and materials shown in this disclosure without departing from the scope and spirit of the invention.

I claim:

1. A back-up lighting system for mounting on a support structure of a light fixture comprising a primary light source, the back-up lighting system comprising:

(a) at least two components adapted to extend at least partially around the support structure at a position below the primary light source, each component comprising:
  (i) a housing comprising a thermally conductive material;
  (ii) a plurality of light emitting diodes retained at least partially within the housing; and
  (iii) a lens retained at least partially within the housing; and (b) a controller adapted to detect a loss of power to the primary light source and activate the plurality of light emitting diodes of at least one of the at least two components upon detecting the loss of power.

2. The back-up lighting system of claim 1, wherein the controller is further adapted to deactivate the plurality of light emitting diodes after the primary light source is reactivated following restoration of power to the primary light source.

3. The back-up lighting system of claim 1, wherein the plurality of light emitting diodes are activated after power is restored to the primary light source.

4. The back-up lighting system of claim 1, wherein the plurality of light emitting diodes are activated before power is restored to the primary light source.

5. The back-up lighting system of claim 1, wherein the primary light source is powered by a primary power source and wherein the plurality of light emitting diodes are powered by the primary power source.

6. The back-up lighting system of claim 1, wherein the primary light source is powered by a primary power source and wherein the plurality of light emitting diodes are powered by a secondary power source.

7. The back-up lighting system of claim 6, wherein the secondary power source comprises at least one battery.

8. The back-up lighting system of claim 1, wherein the housing comprises fins configured to dissipate heat generated by the plurality of light emitting diodes.

9. The back-up lighting system of claim 1, wherein the at least two components define an aperture in which the support structure is positioned when the at least two components are mounted on the support structure.

10. The back-up lighting system of claim 1, further comprising a gasket adapted for positioning intermediate the at least two components and the support structure.

11. The back-up lighting system of claim 1, wherein the at least two components are adapted to extend entirely around the support structure.

12. The method of claim 11, wherein the at least two components are identical.

13. A back-up lighting system for mounting on a support structure of a light fixture comprising at least one high intensity discharge lamp, the back-up lighting system comprising:

(a) at least two components adapted to extend at least partially around the support structure at a position below the high intensity discharge lamp, each component comprising:
  (i) a housing comprising a thermally conductive material;
  (ii) a plurality of light emitting diodes retained at least partially within the housing; and (iii) a lens retained at least partially within the housing;

(b) at least one mounting gasket for positioning intermediate the at least two components and the support structure; and (c) a controller adapted to detect a loss of power to the at least one high intensity discharge lamp and activate the plurality of light emitting diodes of at least one of the at least two components after detecting the loss of power.

14. The back-up lighting system of claim 13, wherein the controller is adapted to activate the plurality of light emitting diodes after power is restored to the at least one high intensity discharge lamp.

15. The back-up lighting system of claim 13, wherein the controller is adapted to activate the plurality of light emitting diodes before power is restored to the at least one high intensity discharge lamp.

16. The back-up lighting system of claim 13, wherein the controller is further adapted to deactivate the plurality of light emitting diodes after the at least one high intensity discharge lamp is reactivated following restoration of power to the at least one high intensity discharge lamp.

17. The back-up lighting system of claim 13, wherein the at least two components are adapted to extend entirely around the support structure.

18. The method of claim 13, wherein the at least two components are identical.

19. A method of providing back-up lighting to a light fixture comprising a primary light source and supported by a support structure, the method comprising:

(a) providing a back-up lighting system comprising at least two components, each component comprising:

(i) a housing comprising a thermally conductive material;

(ii) a plurality of light emitting diodes retained at least partially within the housing; and (iii) a lens retained at least partially within the housing;

(b) mounting the at least two components of the back-up lighting system to the support structure at a location below the primary light source and so that the at least two components extend at least partially around the support structure;

(c) detecting a power loss to the primary light source; and (d) activating the plurality of light emitting diodes of at least one of the at least two components upon detecting the loss of power.

20. The method of claim 19, wherein activating the plurality of light emitting diodes comprises activating the plurality of light emitting diodes after power has been restored to the primary light source.

21. The method of claim 19, wherein activating the plurality of light emitting diodes comprises activating the plurality of light emitting diodes before power has been restored to the primary light source.

22. The method of claim 19, further comprising deactivating the plurality of light emitting diodes after power has been restored to the primary light source and the primary light source is reactivated.

23. The method of claim 19, wherein mounting the at least two components of the back-up lighting system comprises mounting the at least two components so that the at least two components extend entirely around the support structure.

* * * * *